US006604764B2

(12) United States Patent
Zemzik

(10) Patent No.: US 6,604,764 B2
(45) Date of Patent: Aug. 12, 2003

(54) SAFETY LATCH

(76) Inventor: Andrew W. Zemzik, 22 Brandywine Ct., Washington Crossing, PA (US) 18977

( * ) Notice: Subject to any disclaimer, the term of this patent is extended or adjusted under 35 U.S.C. 154(b) by 0 days.

(21) Appl. No.: 09/930,633

(22) Filed: Aug. 15, 2001

(65) Prior Publication Data

US 2003/0034656 A1 Feb. 20, 2003

(51) Int. Cl.[7] ..... E05C 19/18
(52) U.S. Cl. ..... 292/293; 292/288
(58) Field of Search ..... 24/616, 324, 297; 292/288, 289, 290, 293, 296, 297, 298, 10, 13

(56) References Cited

U.S. PATENT DOCUMENTS

| | | | | | |
|---|---|---|---|---|---|
| 3,938,839 | A | * | 2/1976 | Collier | 292/258 |
| 4,198,088 | A | * | 4/1980 | Tochihara | 292/288 |
| 4,657,293 | A | * | 4/1987 | Bell | 292/258 |
| 4,881,764 | A | * | 11/1989 | Takahashi | 292/13 |
| 5,566,993 | A | * | 10/1996 | Olivas | 292/288 |
| 6,327,743 | B1 | * | 12/2001 | Rashid | 16/82 |

* cited by examiner

*Primary Examiner*—Gary Estremsky
(74) *Attorney, Agent, or Firm*—Armand M. Vozzo, Jr.

(57) ABSTRACT

An improved safety latch is disclosed for assembly and use upon a cabinet frame or like facing member to secure a drawer or cabinet door panel in a completely closed position without need for an invasive screw attachment. The present safety latch includes a U-shaped base fitting formed having front and rear walls spaced apart to engage the edge of the cabinet frame within therebetween, the rear wall in a preferred embodiment of the latch having a movable pad mounted on the interior side of the wall to clamp the frame and hold the fitting in a stationary position. The front wall of the base fitting is provided with a pair of flexible prong members extended outwardly from the front wall and further formed having opposed wedge-shaped ends. The safety latch further includes an angled clip member adapted to releasably engage the base fitting having an open chamber section formed along the top of the clip member and a wall section depending perpendicularly therefrom. With the base fitting secured upon the edge of the cabinet frame, the chamber section of the clip member engages the prong members along the perimeter of the cabinet panel intended to be closed and the wall section abuts the front face of the panel locking it in a closed position between the wall section and the front wall of the base fitting. Inward deflection of the prong members through side vents in the open chamber section disengages the clip member from the base fitting and releases the panel to open.

10 Claims, 5 Drawing Sheets

SAFETY LATCH

BACKGROUND OF THE INVENTION

The present invention relates to fastening devices for cabinet doors and drawers, and more particularly to an improved safety latch device for fastening a drawer or door of a cabinet without need of a screw-mounted attachment and in a completely closed position that is resistant to opening by young children.

For many years now, "child-proof" safety latches have been devised and used, primarily in households, to prevent access by young children to certain cabinet areas that store potentially harmful or dangerous items. These safety latches have been designed to be difficult or impossible for young children to operate but may be easily operated by an adult. Known prior art child-proof latches have required fixed installation, typically via screw attachment, and proper adjustment of two or more separate elements that have been found to be time-consuming and difficult especially in the confined cabinet spaces in which such latches are typically employed. When such a latch is initially installed and then found to be improperly adjusted, it becomes necessary to remove or loosen the latch elements, make the desired adjustments, and reinstall the latch, sometimes marring the cabinet surfaces on which the latch operates. This difficult process of adjustment and reinstallation of prior art latches can prove even more aggravating when the particular latch may be required as a safety closure for only a short period of time or on a temporary basis.

In addition to these problems associated with their installation, previously known child-proof latches have commonly been designed to operate on a door or drawer panel in a fashion that does not close the panel tightly, but rather that allows the door or drawer panel to be opened to a limited extent, after which it is necessary to reach into the drawer or cabinet space and release the latch to enable the panel to be opened further. The release of the latch overtop the slightly open panel is relatively easy for the adult and generally difficult for the young child to manipulate. However, a child, particularly with relatively small hands and fingers, may well be able to reach over the top of the door or drawer panel and release the latch nonetheless through the limited opening provided.

As such, it can be appreciated that there continues to be a need for a new and improved child-proof safety latch for cabinet doors and drawer panels that addresses the limitations of the prior art devices in their implementation and manner of installation as well as in their ease of operation and effectiveness.

SUMMARY OF THE INVENTION

Accordingly, it is a general purpose and object of the present invention to provide an improved safety latch for cabinet doors and drawers that is resistant to opening by young children and easier to install than those child-proof latches heretofore devised and developed.

A more particular object of the present invention is to provide an improved child-resistant safety latch that can be easily implemented and assembled for operation upon a cabinet drawer or door panel without any screw or other subsurface attachment.

Another object of the present invention is to provide child-proof safety latch that is effective and able to be assembled for use on a temporary basis whenever and wherever necessary on household cabinets.

Still another object of the present invention is to provide a child resistant safety latch that can tightly close a cabinet drawer or door panel without allowing its opening, even slightly, until release of the latch.

A still further object of the present invention is to provide a childproof safety latch that is relatively inexpensive to manufacture, easy to assemble and implement, and reliable in its operation.

Briefly, these and other objects of the present invention are accomplished by an improved safety latch specially adapted for assembly and use upon a cabinet frame or like facing member to secure a drawer or cabinet door panel in a completely closed position without need for an invasive screw attachment. The present safety latch includes a U-shaped base fitting formed having front and rear walls spaced apart to engage the edge of the cabinet frame therebetween, the rear wall in a preferred embodiment of the latch having a movable pad mounted on the interior side of the wall to clamp the frame and hold the fitting in a stationary position. The front wall of the base fitting is provided with a pair of flexible prong members extended outwardly from the front wall and further formed having opposed wedge-shaped ends. The safety latch further includes an angled clip member adapted to releasably engage the base fitting having an open chamber section formed along the top of the clip member and a wall section depending perpendicularly therefrom. With the base fitting secured upon the edge of the cabinet frame, the chamber section of the clip member engages the prong members along the perimeter of the drawer or cabinet panel intended to be closed and the wall section abuts the front face of the panel locking it in a closed position between the wall section and the front wall of the base fitting. Inward deflection of the prong members through side vents in the open chamber section disengage the clip member from the base fitting and releases the panel to open.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DETAILED DESCRIPTION OF THE INVENTION

Figure 1:
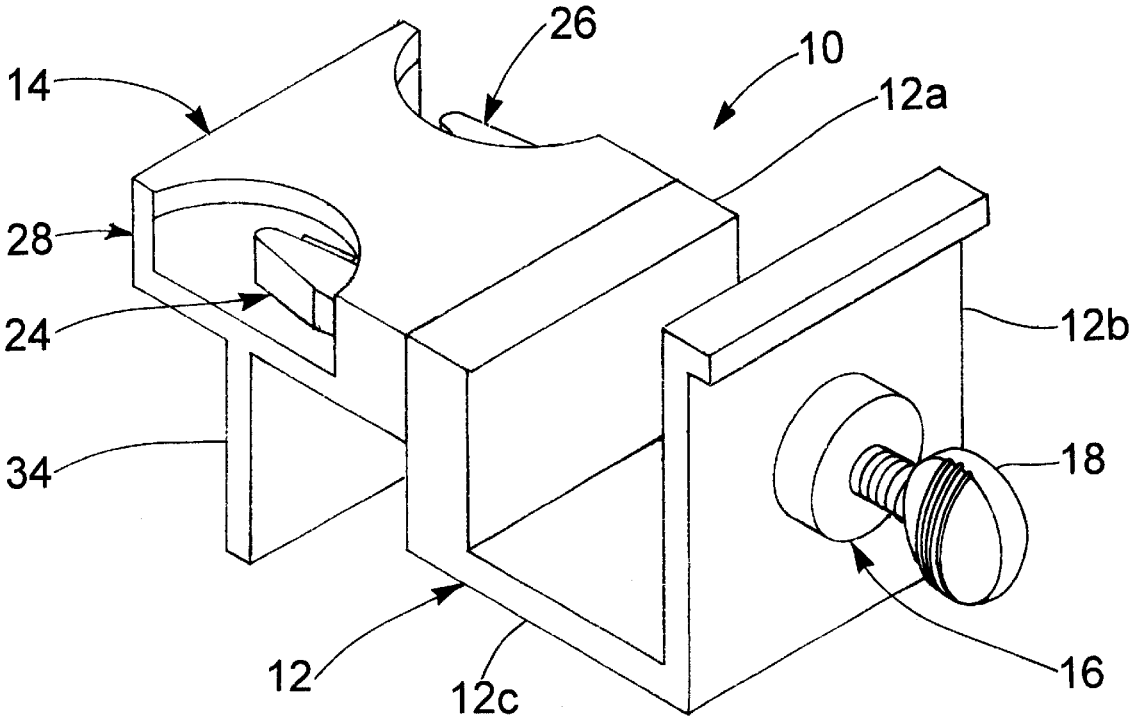
FIG. 1 is a perspective view of a preferred embodiment of the safety latch assembled according to the present invention and shown as it is intended for use in connection with a cabinet frame and associated panel required for closure.

Referring now more particularly to the drawings and to the embodiments of the invention here presented by way of illustration, FIG. 1 shows a safety latch, generally designated 10, that is assembled comprising a base fitting 12 and a clip member 14 releasably connected thereto. The base fitting 12 is formed having a substantially U-shaped body that includes a front wall 12*a* and a substantially parallel rear wall 12 spaced apart by a bottom wall 12*c* extending between the front and rear walls substantially perpendicular to both. Described in greater detail below in reference to FIGS. 3–5, the base fitting 12 is further formed having a pair of prong members 24 and 26 that extend forwardly from the front wall 12*a* to provide a means for engaging the base fitting with the clip member 14 in a releasable assembly according to the present invention. In the particular embodiment shown in FIG. 1, the base fitting 12 is further provided with an adjustable clamping means 16 including a thumbscrew 18 or like type of screw fastener that is threadingly coupled through the rear wall 12*b* of the fitting to adjust the spacing between the front wall 12*a* and rear wall and secure the fitting in its mounted position. The clip member 14, described in greater detail below in reference to FIGS. 6–8, has a substantially T-shaped cross section and comprises an upper chamber section 28 within which the prong members 24 and 26 of the base fitting 12 may be inserted for engagement through an open slotted end 30 and a lower wall section 34 depending perpendicularly from the chamber section in a plane that is substantially parallel to the front wall 12*a* of the base fitting when the safety latch 10 is assembled, as shown in FIG. 1. It is preferably intended that the base fitting 12 and clip member 14 both be relatively rigid but resilient in their construction, and that each be integrally formed preferably of a plastic material, such as polypropylene, nylon, or other similar plastic suitable for injection molding or other conventional manufacturing process.

Figure 2:
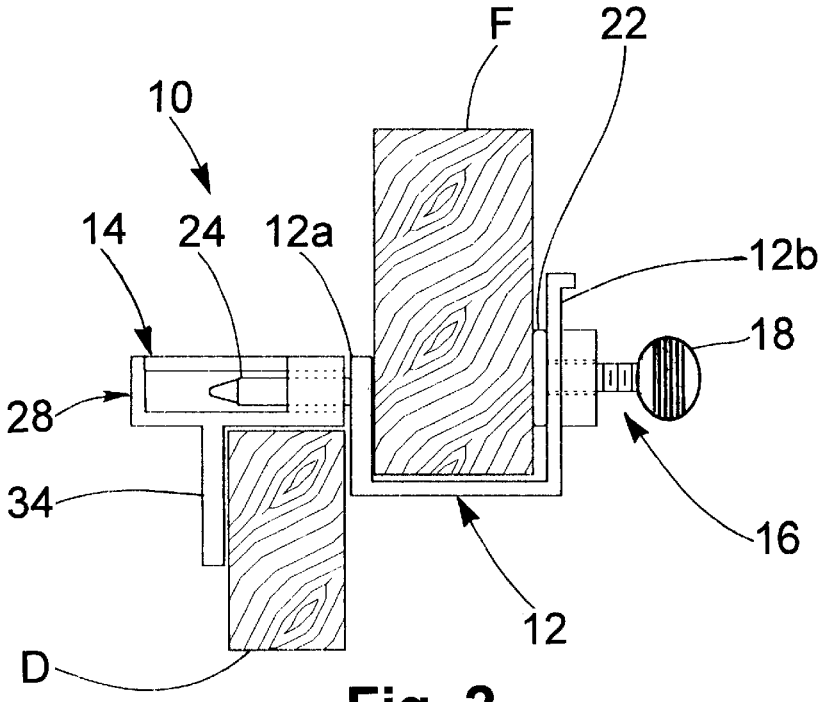
FIG. 2 is a side elevational view of the safety latch of FIG. 1 shown in engagement about a cabinet frame and associated panel intended for closure.

Referring now to FIG. 2 in conjunction with FIG. 1, the safety latch 10 is assembled in operative engagement upon a cabinet jamb or frame F and a cabinet drawer or door panel D that is movable relative to the frame and intended to be secured by the safety latch. Base fitting 12 is adapted to fit over and upon the edge of the cabinet frame F with the open end of the base fitting accepting the full thickness of the frame within the spacing width between the front wall 12*a* and rear wall 12*b* of the fitting. The spacing width provided between the front wall 12*a* and rear wall 12*b* of base fitting 12 is therefore made to be slightly larger in dimension than the standard thickness of the conventional cabinet frame, typically 11/16 to 7/8 of an inch.

The base fitting 12 is intended to be fully inserted upon the edge of cabinet frame F in the position as shown in FIG. 2, having the end surface of the edge substantially abutting the bottom wall 12*c* of the fitting. With the base fitting 12 fully inserted upon the edge of cabinet frame F, the clamping means 16 may be used, particularly through rotation of thumbscrew 18, to grip the cabinet frame tightly between the front and rear walls, 12*a* and 12*b* respectively, and hold the base fitting securely to the cabinet frame. A contact pad 22 attached to the end of thumbscrew 18 and positioned on the interior side of rear wall 12*b* of base fitting 12 is preferably used to apply clamping pressure to the cabinet frame F, as may be needed, without marring the surface thereof.

As further shown in FIG. 2, the clip member 14 is engaged with the mounted base fitting 12 just forward of the front wall 12*a* of the fitting, engagement being effected by inserting the slotted end 30 of chamber section 28 onto the prong members 24 and 26 that project outward from the cabinet frame F with the base fitting mounted thereon. Disposed in parallel alignment on the front wall 12*a* of base fitting 12, as better viewed in FIGS. 3–5, the prong members 24 and 26 on the mounted base fitting are made to extend over the edge of the cabinet drawer or door panel D when the panel is closed against the cabinet frame F so that the chamber section 28 of the clip member 14 can engage the prong members along the perimeter of the panel. In the operative position of the safety latch 10 shown in FIG. 2, the upper chamber section 28 of the clip member 14 is fully engaged and locked onto the prong members 24 and 26 while the lower wall section 34 is urged upon and abuts the forward face of the drawer or door panel D thereby pressing the panel against the cabinet frame F and maintaining closure of the panel while the safety latch is assembled and engaged in its operative position. As described in greater detail below, disengagement of the clip member 14 from the base fitting 12 is effected by inward deflection of the prong members 24 and 26 through vents or notches 32 formed similarly on both sides of the chamber section 28.

Figure 3:
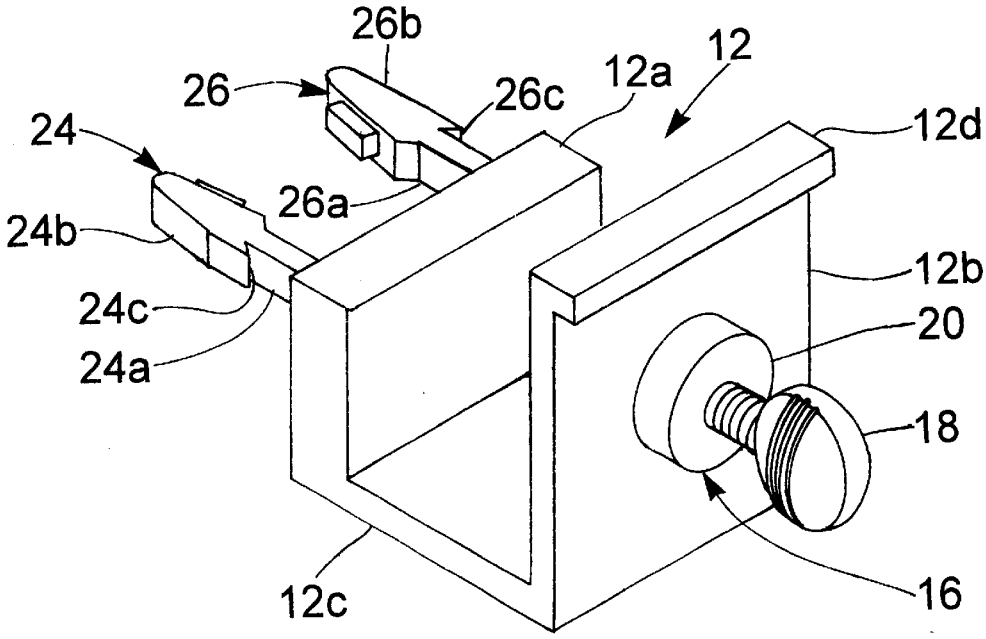
FIG. 3 is a perspective view of the base fitting shown apart from the safety latch of FIG. 1.
Figure 4:
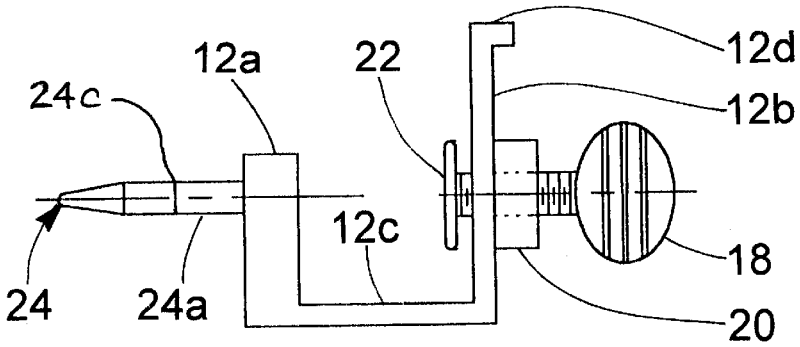
FIG. 4 is a side plan view of the base fitting shown in FIG. 3.
Figure 5:
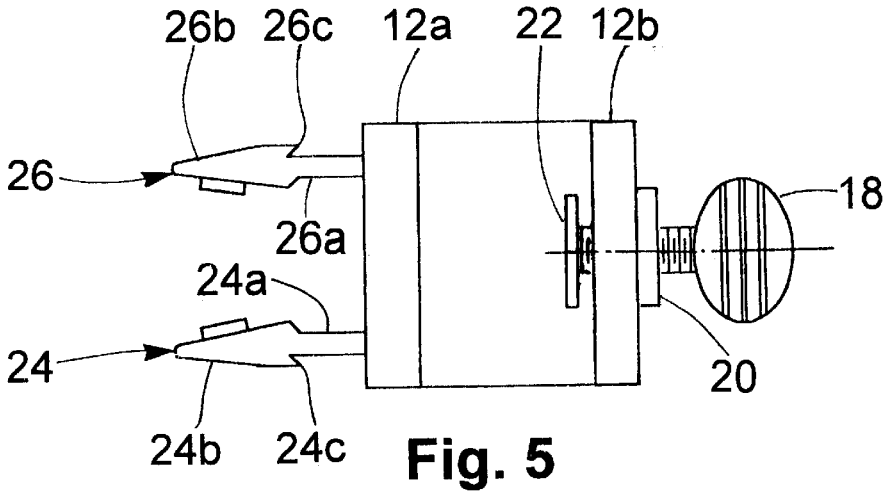
FIG. 5 is a top plan view of the base fitting shown in FIG. 3.

Referring now to FIGS. 3–5, the base fitting 12 is shown in detail comprising front wall 12*a*, rear wall 12*b* and bottom wall 12*c* integrally formed in a substantially U-shaped configuration, the front and rear wall being substantially parallel to each other and at right angles to the bottom wall. Extending integrally from the front wall 12*a* are separate resilient prong members 24 and 26 similarly formed but opposed in their respective profiles. The prong members 24 and 26 each extend substantially perpendicular from the front wall 12*a* and are aligned horizontally with each other. The prong members 24 and 26 are made to be resilient and capable of withstanding repeated deflection in the common plane between them. Each prong member 24 and 26 is formed having a resilient arm 24*a* and 26*a* that extends from the front wall 12*a* of the base fitting. At the outer end of each arm 24*a* and 26*a*, a wedge-shaped cam surface 24*b* and 26*b* is provided on each prong member 24 and 26 facing in opposite directions so that the cam surfaces are outwardly directed on each of the prong members. The wedge-shaped cam surfaces 24*b* and 26*b* thus each provide a narrowed tip and reverse incline on each respective prong members 24 and 26 that facilitates the insertion and movement of the prong members within the chamber section 28 of the clip member 14. An abrupt shoulder 24*c* and 26*c* is formed at the inward end of the cam surfaces 24*a* and 26*a* along the intermediate length of each prong member 24 and 26 to provide opposed latching surfaces for locking engagement of the prong members within the chamber section 28 of the clip member 14.

Clamping means 16 provided on the rear wall 12*b* of the base fitting 12 includes the thumbscrew 18 threadingly mounted near the center of the rear wall and coupled thereto using a threaded collar 20 or other similar member designed to support the thumbscrew and hold it firmly in place while in use. Threaded rotation of the thumbscrew 18 is thus supported by the collar 20 and serves to move contact pad 22 back and forth thereby applying adjustable clamping pressure to the surface of the cabinet frame F on which the base fitting 12 is to be mounted. The application of clamping pressure to the cabinet frame F by means of the thumbscrew 18 and contact pad 22 ensures the firm and stationary mounting of the base fitting 12 on the cabinet frame during use of the safety latch 10. Reverse rotation of the thumbscrew 18 will withdraw the contact pad 22 and allow the base fitting 12 to be easily removed from the cabinet frame F. An upper lip 12*d* outwardly formed at the top of the rear wall 12*b* serves to assist in manipulating the base fitting 12 within the cabinet frame F both in the mounting and removal of the fitting.

Figure 6:
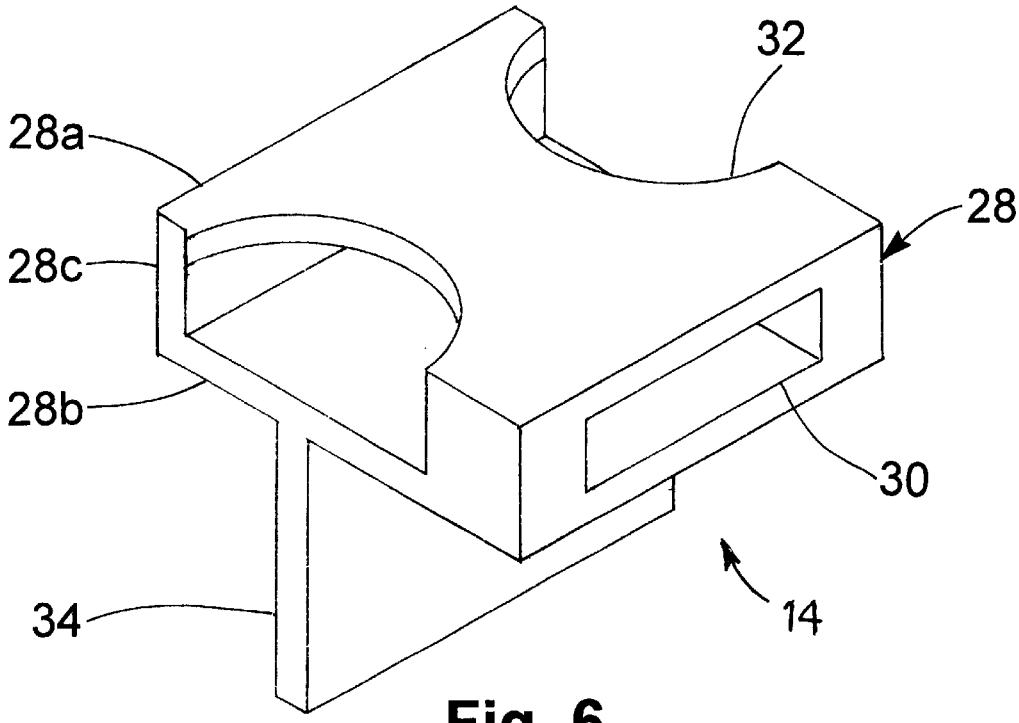
FIG. 6 is a perspective view of the clip member shown apart from the safety latch of FIG. 1.
Figure 7:
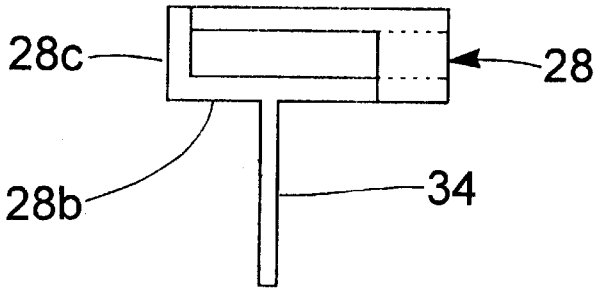
FIG. 7 is a side plan view of the clip member of the present invention shown in FIG. 6.
Figure 8:
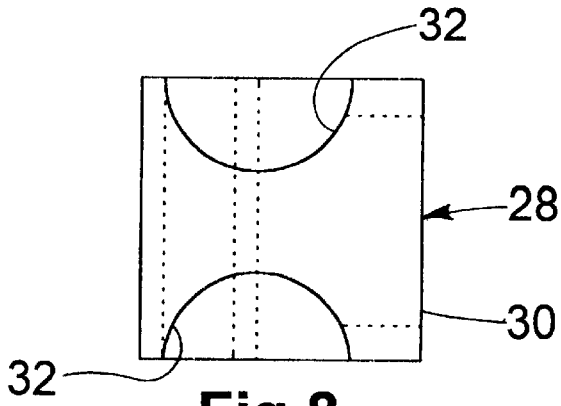
FIG. 8 is a top plan view of the clip member of FIG. 6.
Figure 9:
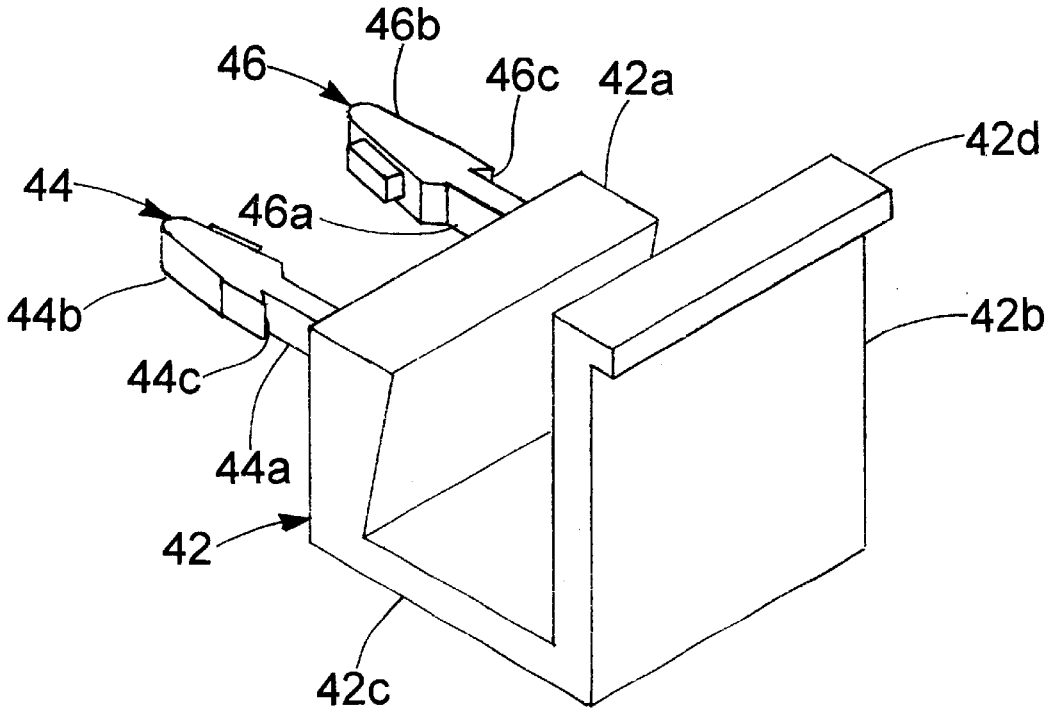
FIG. 9 is a perspective view showing an alternate embodiment of a base fitting of the safety latch according to the present invention.
Figure 10:
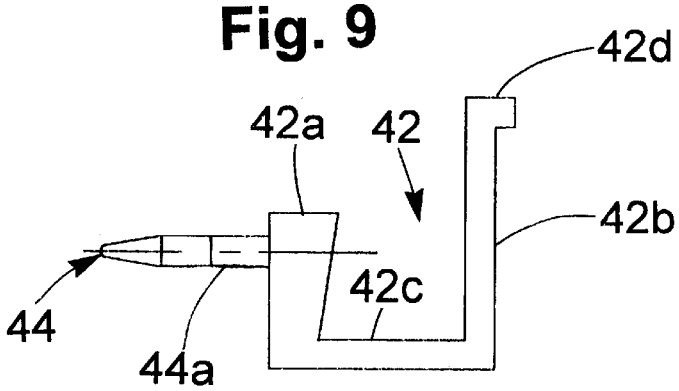
FIG. 10 is a side plan view of the base fitting of the present invention shown in FIG. 9.
Figure 11:
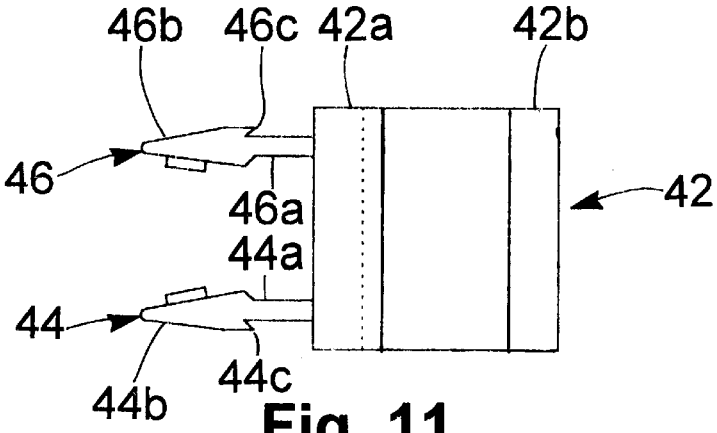
FIG. 11 is a top plan view of the base fitting of FIG. 9.

Referring now more particularly to FIGS. 6–8, the clip member 14 is an integrally formed member most suitably molded of a plastic material and having a T-shaped configuration that includes the chamber section 28 along the top of the clip member and the solid wall section 34 depending perpendicularly from the chamber section in a plane transverse thereto. The chamber section 28 is a box-like receptacle in form having an essentially rectangular configuration comprising a top wall 28*a*, bottom wall 28*b* and end wall 28*c*. The top wall 28*a* is provided with curved notches 32 substantially along both sides thereof to provide finger access into the chamber section 28 particularly for permitting deflection and release of prong members 24 and 26 engaged within the chamber section. Opposite from the solid end wall 28*c*, the slotted end surface 30 of the chamber section 28 is disposed and provided to permit entry of the prong members 24 and 26 into the chamber section and to allow engagement with the base fitting 12. As best seen in FIG. 6, the slotted end surface 30 of the chamber section 28 provides a substantially rectangular opening for passage of the prong members 24 and 26 of base fitting 12 both during assembly of the safety latch 10 and upon disassembly and release of the latch when the clip member 14 is disengaged from the base fitting.

In conjunction with the base fitting 12 described above in reference to FIGS. 3–5, the wedge-shaped cam surfaces 24*b* and 26*b* are designed to allow deflection of the respective prong members 24 and 26 so that upon insertion into the slotted end surface 30 of the clip member 14, the wall thickness on each side of the opening in the slotted end surface serves to initially deflect the respective prong members inwardly. The wall thickness provided on each side of the slotted end surface 30 further extends a predetermined distance along the side and into the chamber section 28 based upon the length of the prong members 24 and 26 and particularly the location of the intermediate shoulder 24*c* and 26*c*. Upon full insertion of the prong members 24 and 26 through the slotted end surface 30 of the chamber section 28, the respective shoulders 24*c* and 26*c* of the prong members snap into locking engagement with the sides of the chamber section at the forward most edge of the notches 32 thereby securing the base fitting 12 and clip member 14 in their operative assembly. In this operative assembly of the safety latch 10, best seen in FIG. 2, the clip member 14 is joined to the base fitting 12 with the slotted end surface 30 of the clip member immediately adjacent the front wall 12*a* of the base fitting and the prong members 24 and 26 respectively contained within the chamber section 28, both held in place by the forced engagement of their respective shoulders 24*c* and 26*c* with the sides of the chamber section. Disengagement of the prong members 24 and 26 from the chamber section 28 and disassembly of clip member 14 from the base fitting 12 is effected by applying inward pressure or squeezing the prong members 24 and 26 through the notches 32 on both sides of the chamber section 28 thereby releasing the respective shoulders 24*c* and 26*c* of the prong members and allowing the clip member to be removed therefrom.

It should be noted and understood that the wall section 34 of the clip member 14 projects downward from the chamber section 28 a sufficient length to extend alongside the edge of the drawer or door panel D intended to be closed by the present safety latch 10. The width of the wall section 34 is preferably the same width of the chamber section 28 from which its depends, as is shown in FIGS. 6–8, but may vary depending upon the particular application and the size of the panel D to be closed. The location of the wall section 34, particularly its spacing relative to the slotted end surface 30 of the chamber section 28, is determined based upon the thickness of the drawer or door panel D intended for closure, the spacing provided between the wall section and the slotted end of the chamber section being sufficient to contain the fill thickness of the panel, typically in the range of 11/16 to 7/8 of an inch.

Figure 12:
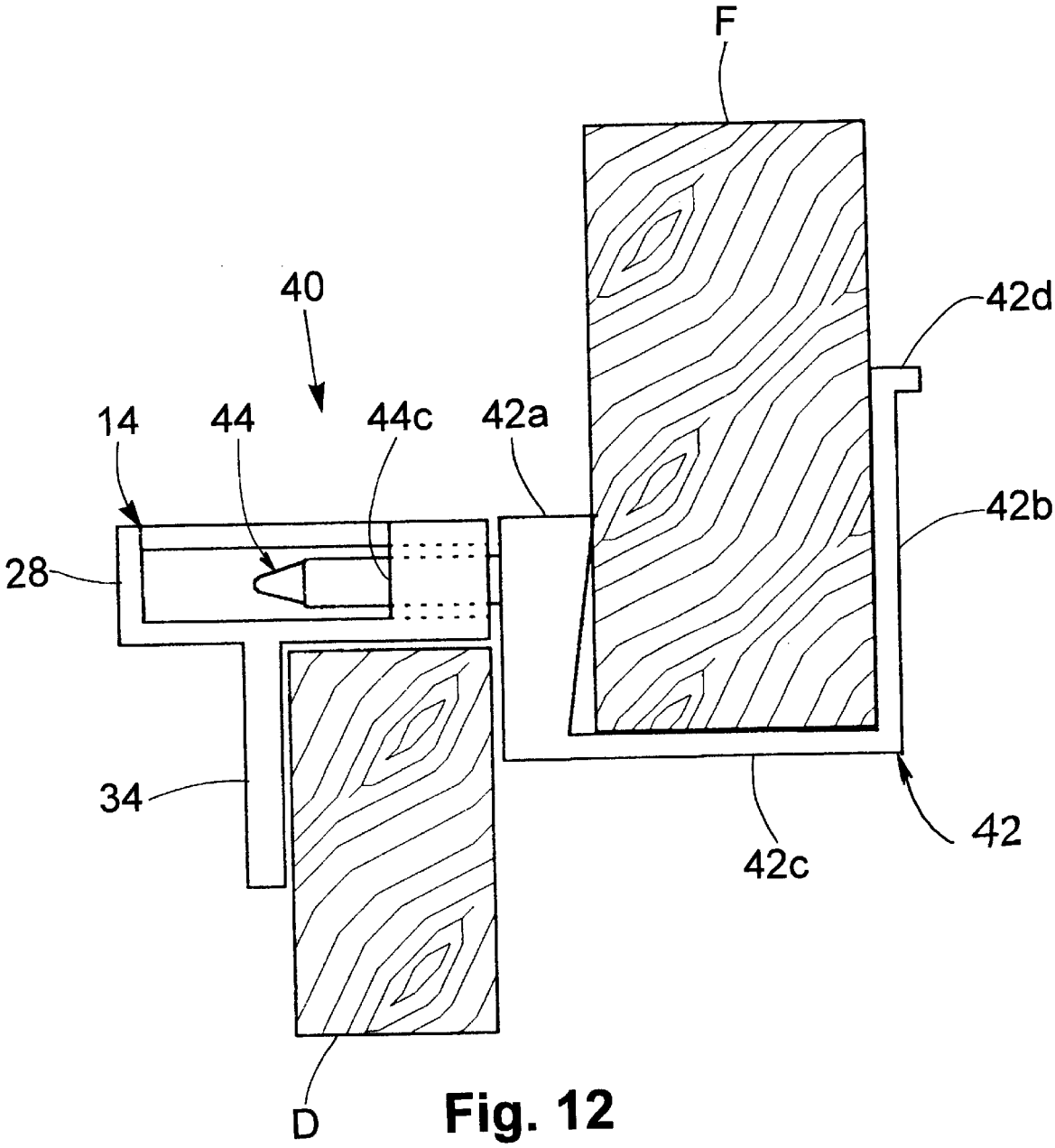
FIG. 12 is a side elevational view of an alternate embodiment of the safety latch assembled with the base fitting of FIGS. 9–11 and shown in engagement about a cabinet frame and associated panel intended for closure in accordance with the present invention.

Referring now to FIGS. 9–12, a modified version of a base fitting 42 is shown for use in accordance with an alternate embodiment of the present invention, generally designated 40 in FIG. 12. In this modified version of base fitting 42, the front wall 42*a* is altered in its configuration from the front wall 12*a* as previously shown and described relative to base fitting 12. On base fitting 42, the inner surface of the front wall 42*a* is formed having an inwardly inclined surface extending from the bottom wall 42*c* to the top of the front wall and thereby providing a wedge-like clamp on the cabinet frame F upon which the base fitting is mounted. As a result of this wedge-like clamp applied by the inclined surface of front wall 42*a* to the forward surface of the cabinet frame F, the base fitting 42 may be employed without thumbscrew 18 or other clamping means provided upon the rear wall 12*b* of base fitting 12. In all other respects, the construction of the modified base fitting 42 is similar to that of base fitting 12 including the form and structure of prong members 44 and 46 having respective arms 44*a* and 46*a*, wedge-shaped cam surfaces 44*b* and 46*b*, and intermediate shoulders 44*c* and 46*c* that together engage the chamber section 28 of the clip member 14 to hold the drawer or door panel D in closed position as shown in FIG. 12. Disengagement of prong members 44 and 46 from the chamber section 28 and disassembly of the clip member 14 from base fitting 42 is similarly effected by squeezing pressure applied to the prong members through the notches 32 on either side of the chamber section. After withdrawal of the clip member 14 from the base fitting 42 that releases the panel D to open, the base fitting may be easily removed from the cabinet frame F by sliding the walls of the fitting from the frame.

Therefore, it is apparent that the described invention provides an improved safety latch for cabinet doors and drawers that is resistant to operation by young children and more easily installed than those child-proof latches heretofore devised. The disclosed safety latch can be easily implemented and mounted for operation upon a cabinet frame to maintain closure of a cabinet door or drawer without any screw or other subsurface attachment to the cabinet. The disclosed invention further provides an effective child-proof latch for household cabinets that can be assembled for use on a temporary basis whenever and wherever necessary to prevent access to storage areas within the cabinets. The present child-resistant safety latch can tightly close a cabinet drawer or door panel, as necessary, without allowing its opening, even slightly, until the latch is fully released. In addition, the described safety latch of the present invention is relatively inexpensive to manufacture, easy to assemble and use, and reliable in its operation as a child-resistant closure device for cabinets. Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. For example, the present prong members 24 and 26 may, within the scope of the present invention, assume alternate shapes and sizes to releasably engage the chamber section 28 of clip member 14. The present chamber section 28 may too assume a different configuration designed to engage and release the present pronged members 24 and 26 or their alternates. For further instance, the prong members may be made in more extended lengths having a repeated number of inclined wedge-shaped surfaces and corresponding shoulders along the respective lengths, much like a ratchet bar. Such an extended series of wedge-shaped and shoulder surfaces would provide a plurality of engagement positions within the chamber section that would be capable of adjusting to a wider range of panel thickness, particularly those in excess of standard sizes. Accordingly, it is understood that this invention is not limited to the particular embodiment described, but rather is intended to cover modifications within the spirit and scope of the present invention as expressed in the appended claims.

What is claimed:

1. A safety latch for use in combination with a cabinet frame or the like to secure a drawer or door panel movable relative to the cabinet framer, comprising:

a base fitting configured for mounting on the cabinet frame along an edge thereof and formed having pronged means projecting forwardly from said fitting and outwardly from the cabinet frame when said fitting is mounted thereon, said pronged means comprising a pair of prong members extending perpendicularly from the front wall of said base fitting, each prong member having a resilient arm and a wedge-shaped end intended for deflection within a common plane, said base fitting comprising a U-shaped body having a front wall, a rear wall and an intermediate wall therebetween, said walls being integrally formed to engage the cabinet frame along the edge thereof with the front wall being formed having an inwardly inclined surface to provide forward clamping of the cabinet frame within said base fitting; and a clip member releasably connected to said base fitting, said clip member being integrally formed having an upper chamber section for releasably engaging the pronged means and a lower wall section depending perpendicularly from the chamber section to hold the drawer or door panel in a closed position relative to the cabinet frame when said clip member is connected to said base fitting.

2. A safety latch according to claim 1, further comprising:

adjustable clamping means coupled to the rear wall of said base fining to secure the cabinet frame between the front and rear walls of said fitting.

3. A safety latch according to claim 2, wherein said adjustable clamping means compromises:

a screw member threadingly coupled to the rear wall of said base fining; and a pad member connected to one end of said screw member and disposed between the front and rear walls of said base fitting to apply adjustable clamping pressure to the cabinet frame.

4. A safety latch according to claim 1, wherein the chamber section of said clip member is formed having a curved notch provided along opposite sides of the chamber section to permit deflection of the prong members within the chamber section.

5. A safety latch for use in combination with a cabinet frame or the like to secure a drawer or door panel movable relative to the cabinet frame, comprising:

a base fitting configured for mounting on the cabinet frame along an edge thereof, said base fitting comprising a U-shaped body having a front wall, a rear wall and an intermediate wall therebetween, said walls being integrally formed to engage the cabinet frame along the edge thereof with the front wall being formed having an inwardly inclined surface to provide forward clamping of the cabinet frame within said base fitting;

pronged means connected to said base fitting and projecting forwardly therefrom in a direction outward from the cabinet frame; and a clip member integrally formed having an upper chamber section adapted to releasably engage said pronged means and a lower wall section perpendicularly extending from the chamber section to hold the drawer or door panel closely to the cabinet frame when said clip member is engaged to said pronged means.

6. A safety latch according to claim 5, wherein said pronged means comprises:

a pair of prong members connected to the front wall of said base fitting and extending perpendicularly therefrom, each prong member formed to deflect in a common direction having a wedge-shaped surface along the end of each member.

7. A safety latch according to claim 6, further comprising:

adjustable clamping means coupled to rear wall of said base fitting to secure the cabinet frame between the front and rear walls of said fitting.

8. A safety latch according to claim 7, wherein said adjustable clamping means comprises:

a screw member threadingly coupled to rear wall of said base fitting; and a pad member connected to one end of said screw member and disposed between the front wind rear walls of said base fitting to apply adjustable damping pressure to the cabinet frame.

9. A safety latch according to claim 6, wherein the chamber section of said clip member is formed having a slotted end to engage said prong members longitudinally within the chamber section.

10. A safety latch according to claim 9, wherein the chamber section of said clip member is further formed having curved notches on opposite sides of the chamber section to permit deflection of said prong members within the chamber section and their disengagement therefrom.

* * * * *